United States Patent [19]

Villa

[11] Patent Number: 4,827,537

[45] Date of Patent: May 9, 1989

[54] PROTECTIVE HELMET OF THE MOVABLE SEGMENT TYPE

[75] Inventor: Paolo Villa, Genoa, Italy

[73] Assignee: SMI S.A., Switzerland

[21] Appl. No.: 140,299

[22] Filed: Dec. 31, 1987

[30] Foreign Application Priority Data

Jan. 30, 1987 [IT] Italy ..... 20696/87[U]

[51] Int. Cl.[4] ..... A42B 3/00

[52] U.S. Cl. ..... 2/410

[58] Field of Search ..... 2/410, 417, 420

[56] References Cited

U.S. PATENT DOCUMENTS

| | | | |
|---|---|---|---|
| 3,514,787 | 6/1970 | Kennedy, Jr. | 2/410 |
| 3,991,422 | 11/1976 | Saotome et al. | 2/410 |
| 4,607,397 | 8/1986 | Laxo | 2/410 |

FOREIGN PATENT DOCUMENTS

| | | | |
|---|---|---|---|
| 150876 | 8/1985 | European Pat. Off. | 2/410 |
| 1053195 | 3/1959 | Fed. Rep. of Germany | 2/410 |

*Primary Examiner*—Wm. Carter Reynolds

*Attorney, Agent, or Firm*—Shlesinger, Fitzsimmons, Shlesinger

[57] ABSTRACT

A protective helmet has a plurality of segments that are interhinged for swinging movement between an expanded operating position and a collapsed non-operating position, and have cooperating ribs and recesses to maintain them in the expanded operating position. There also are pin and slot connections between the segments adapted positively to guide the segments so as assure a correct moving of the segments and a correct reciprocal engagement of the ribs and recesses.

3 Claims, 6 Drawing Sheets

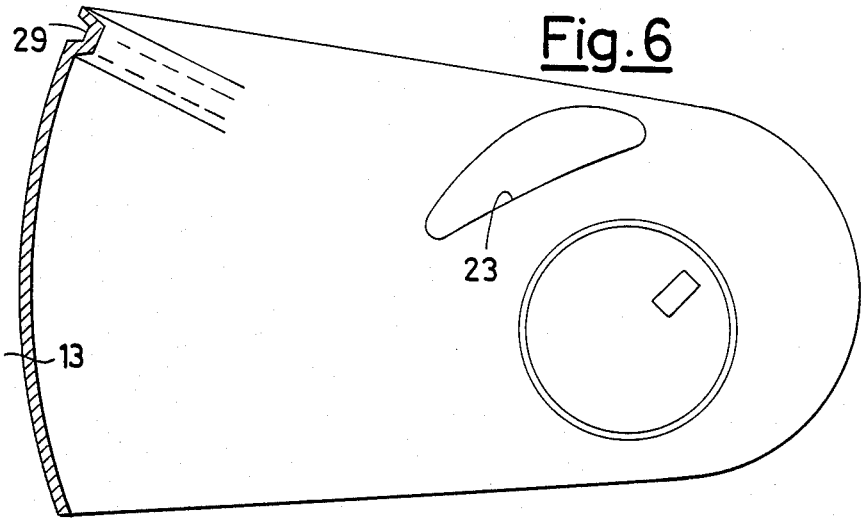
Fig. 6
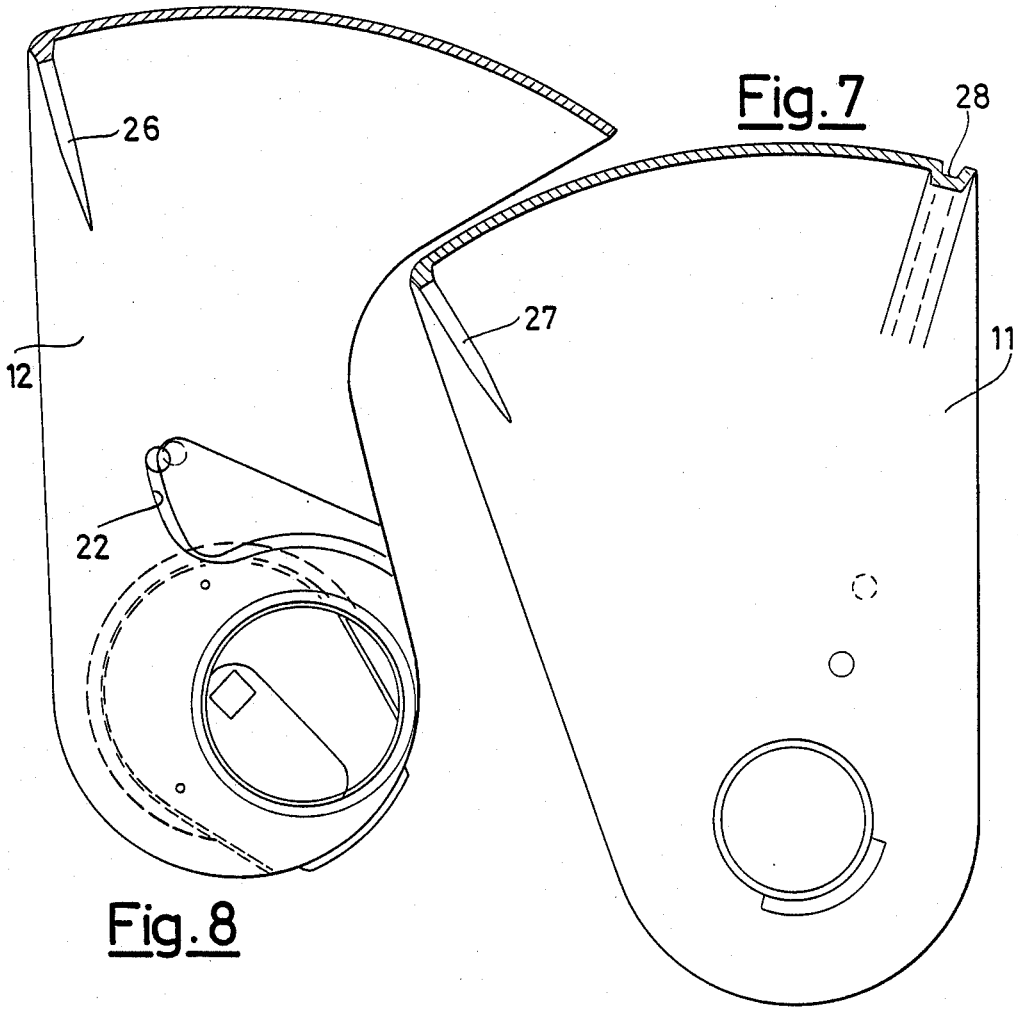
Fig. 7
Fig. 8

PROTECTIVE HELMET OF THE MOVABLE SEGMENT TYPE

The present invention relates to a protective helmet of the type comprising a plurality of segments hinged one to another in a manner movable between an expanded operating position and a collapsed non-operating position.

A helmet of this type is for example described in U.S. Pat. Nos. 3,514,787 and 3,991,422.

When in the collapsed position the segments, which are of a generally arcuate shape with different radii, arrange themselves one overlying the next, so as to occupy a minimun space.

Especially for drivers of motorcycles, this characteristic is an important one inasmuch as during stops on the road a single-piece helmet is always awkward to carry about and, otherwise, calls for means for anchoring it to the motorcycle so as to prevent theft.

On the other hand, a helmet with retractably movable segments can be placed in the box-shaped luggage carrier featured on many motorcycles, or in a small rucksack or even in a small bag.

However, the embodiment of a protective helmet of the type mentioned above requires the solution of the not simple technical problem regarding the stability of the segments in the expanded position and also regarding the system of articulation, since this must be easy to operate.

The overall object of the present invention is to solve the aforesaid technical problems and, in order to do so, the invention embodies a protective helmet of the type comprising: a plurality of segments which are hinged one to the other in a manner movable between an expanded operating position and a collapsed, non-operating position, and reciprocal retaining and locking means acting between the said segments in order to maintain them in the said expanded operating position, wherein guide means adapted to positively guide the said segments also cooperate with the said retaining and locking means so as to ensure a correct moving of the segments and a correct reciprocal engagement between the said retaining means.

The said guide means consist preferably of a series of cams and cam followers formed respectively on adjacent faces of the segments.

The said locking means consist of ribs and complementary notches formed respectively on the inner and outer faces of the said segments.

The structural and functional characteristics of the invention and its advantagges will become more apparent from an examination of the following description, referred to the appended drawings which show an example of a helmet embodied according to the innovative principles of the invention. In the drawings.

Figure 9:
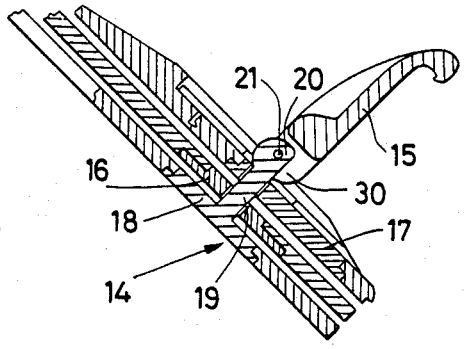

FIG. 6, 7 and 8 respectively show the three segments constituting the helmet; and FIG. 9 is a detail of the system for expanding the segments.

Figure 1:
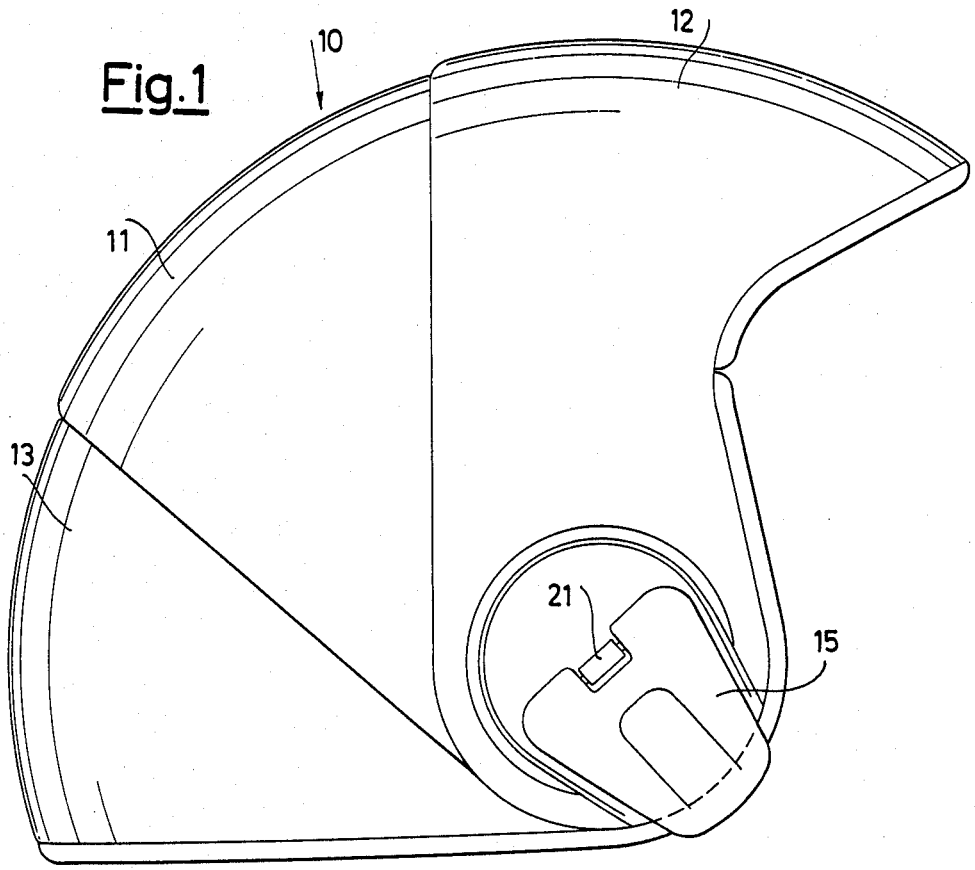
FIG. 1 is a lateral elevation illustrating the said helmet in the expanded position.
Figure 3:
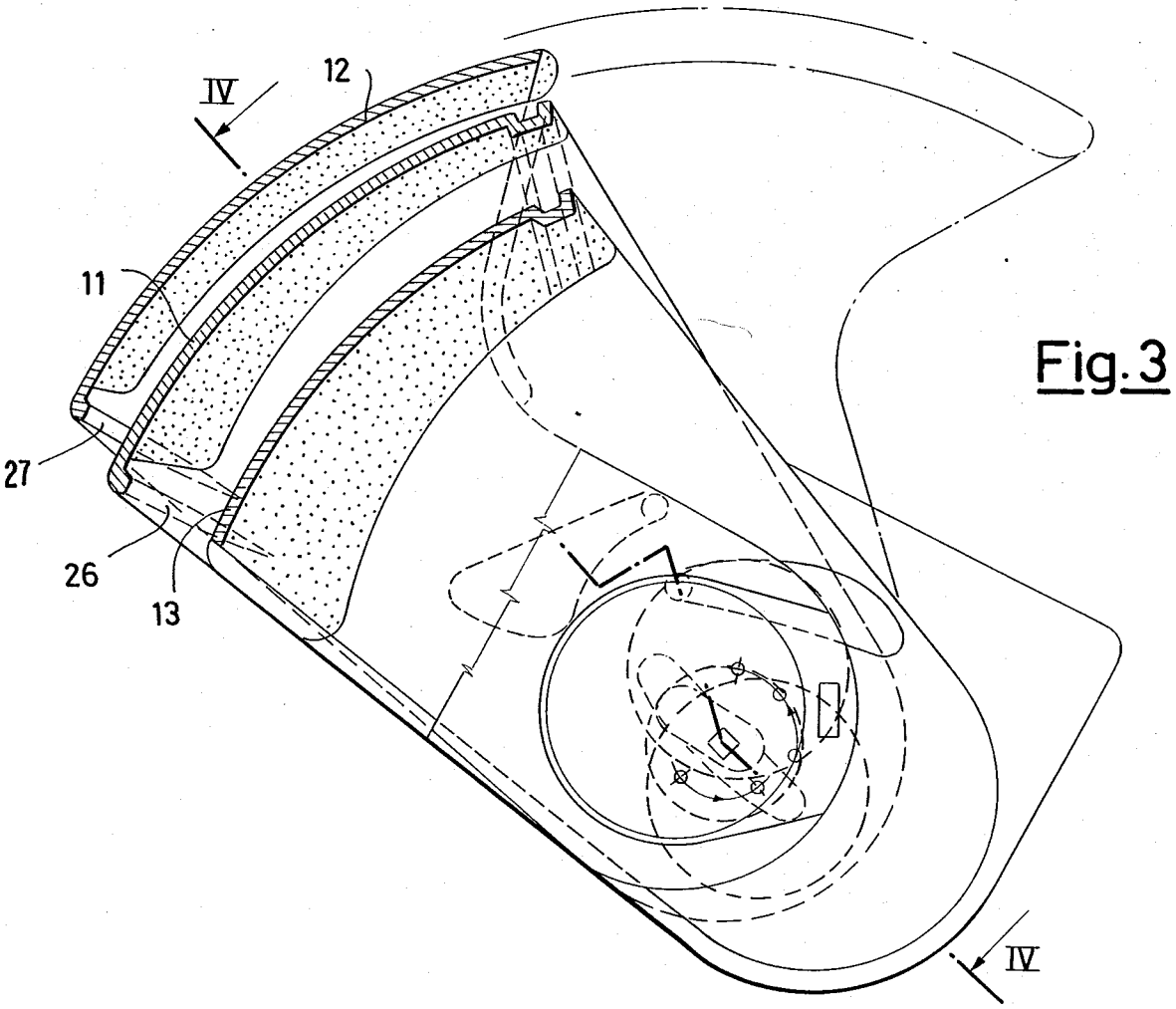
FIG. 3 is a sectional view illustrating the helmet in the collapsed position.

With reference to the drawings, the helmet in question is indicated overall by 10 and consists structurally of a plurality of segments, generally arc-shaped, which are hinged one to another so that they are able to dispose themselves in one of the two positions of expansion or collapse show in FIGS. 1 and 3 respectively.

In the example shown, the helmet 10 comprises a central segment 11 and two terminal segments 12, 13, respectively front and rear.

Figure 4:
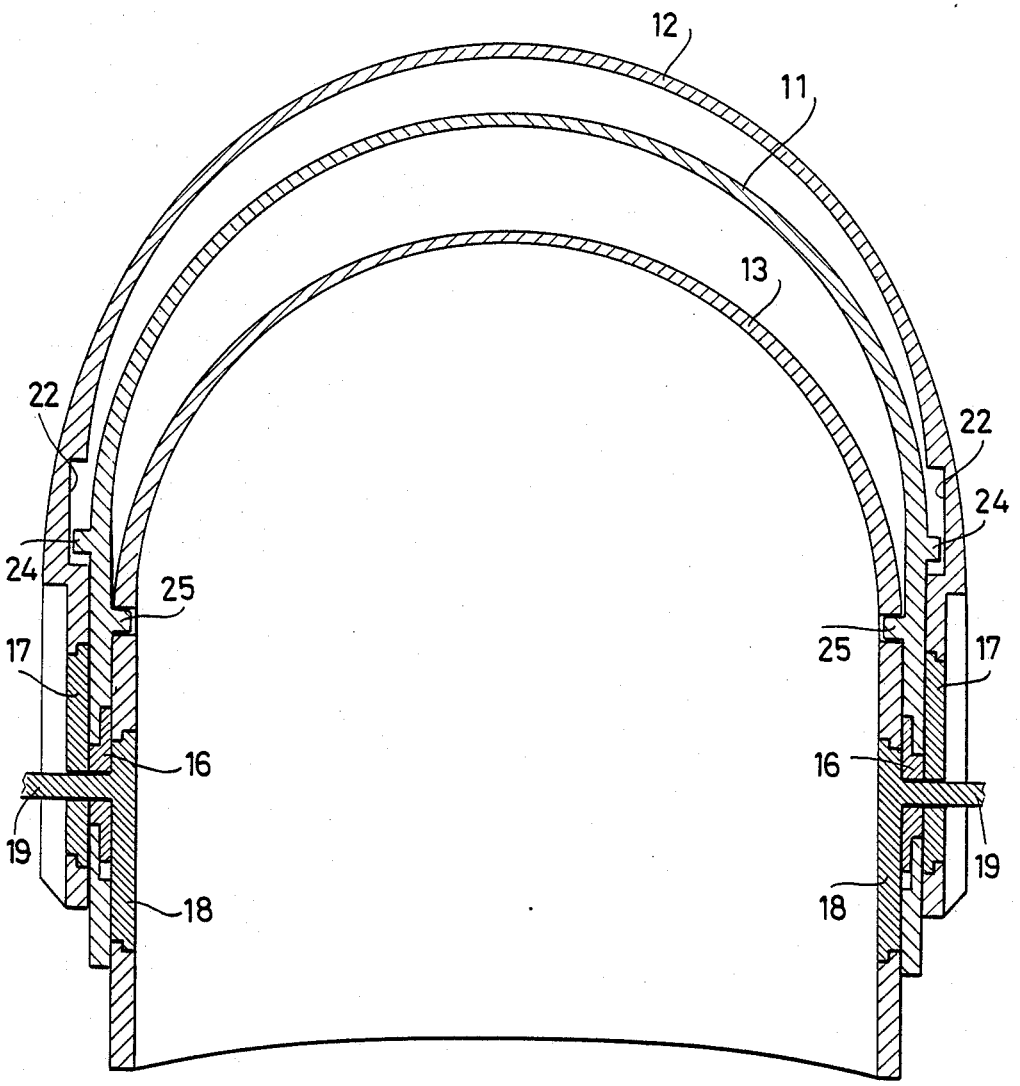
FIG. 4 is a cross-sectional view taken on line IV—IV of FIG. 3.

The segments 11, 12 and 13 are hinged one to another in the region of their opposite sides by the agency of two sets of cams, indicated overall in FIG. 9 by 14 and each able to be actuated by means of its own moving and locking knob 15 (FIG. 4 and 8).

Each set of cams comprises three discs 16, 17 and 18 mounted rotatably within complementary seats formed respectively in the segments 11, 12 and 13. Solid with the disc 18, and slightly offset from the center thereof, is a pin 19 which passes through holes of the discs 16 and 17, the hole in the latter being eccentric and projects outside the helmet as a terminal head 20 to which there is pivoted, at 21, the locking knob 15.

The diameter and eccentricity of the discs 16, 17 and 18 are calculated so that the segments 11, 12 and 13 are caused reciprocally to approach each other and to move apart from each other as a result of rotation of the sets of cams 14 (the moved-apart position of the segments being indicated by a dashed-and-dotted line also in FIG. 3), so as to permit the said segments to be interleaved one with another (in the collapsed position of FIG. 3) or to be in the expanded position of FIG. 1 in which the said segments are disposed in an essentially coplanar approached position, so as to form a segmental hemispherical configuration.

In accordance with the invention, the translation of the segments 11, 12 and 13 between the positions shown in FIGS. 1 and 3 is positively guided, on each side, by a pair of cam guides 22, 23 which act on respective cam followers in the form of pegs 24, 25.

As FIG. 4, 5, 6 and 8 of the drawings clearly show, the guides 22, 23 are respectively formed on the opposite inner faces of the segments 12, 13, while the pegs 24, 25 project from the opposite faces of the central segment 11.

In this way the segments 11, 12 and 13, especially in the helmet-expanding phase (which is actuated by rotation in one direction of both sets of cams 14 by means of knobs 15) are positively guided so as to cause pairs of ribs 26 and 27, formed respectively on the opposite inner faces of the segments 11, 12, to engage complementary notches 28, 29 formed respectively on the outer faces of the segments 11, 13. The guides 22, 23 and respective pegs 24, 25 also act as limit switches and positively form the reciprocal angular position between the moved-apart and expanded segments (indicated by dots-and-dashes in FIG. 3) and guide the radial approach movement determined by the rotation of the sets of cams 14. In this way as the segments are swung by knobs 15 toward their collapsed or folded positions (FIGS. 3 and 4), the cam or eccentric 17, and the pin 25 sliding in slot 23, cause the outer section 12 to move in a predetermined path radially outwardly relative to section 11, while cam 18 and the pin 24 sliding in slot 22 cause section 13 to move in a predetermined path radially away from section 11, for example downwardly in FIG. 4. Conversely, when knobs 15 swing the sections to their expanded positions (FIGS. 1 and 2), the cams 17 and 18, and the guide pins 24 and 25 cause the segments to approach each other radially in a correct reciprocal angular position with no need for the user to maintain them in such position manually; for it would be problematical to bring about this position manually and also move the cams sets 14 by hand at the same time.

The guided radial mutual approach movement of the segments as mentioned above also permits a sure and ready reciprocal mating of restraining means, shown in the from of ribs 26, 27 and complementary notches 28, 29, which ensure that the expanded helmet is monolithic, as is called for by the function of the expanded helmet which is to resist impacts, including violent impact.

Figure 2:
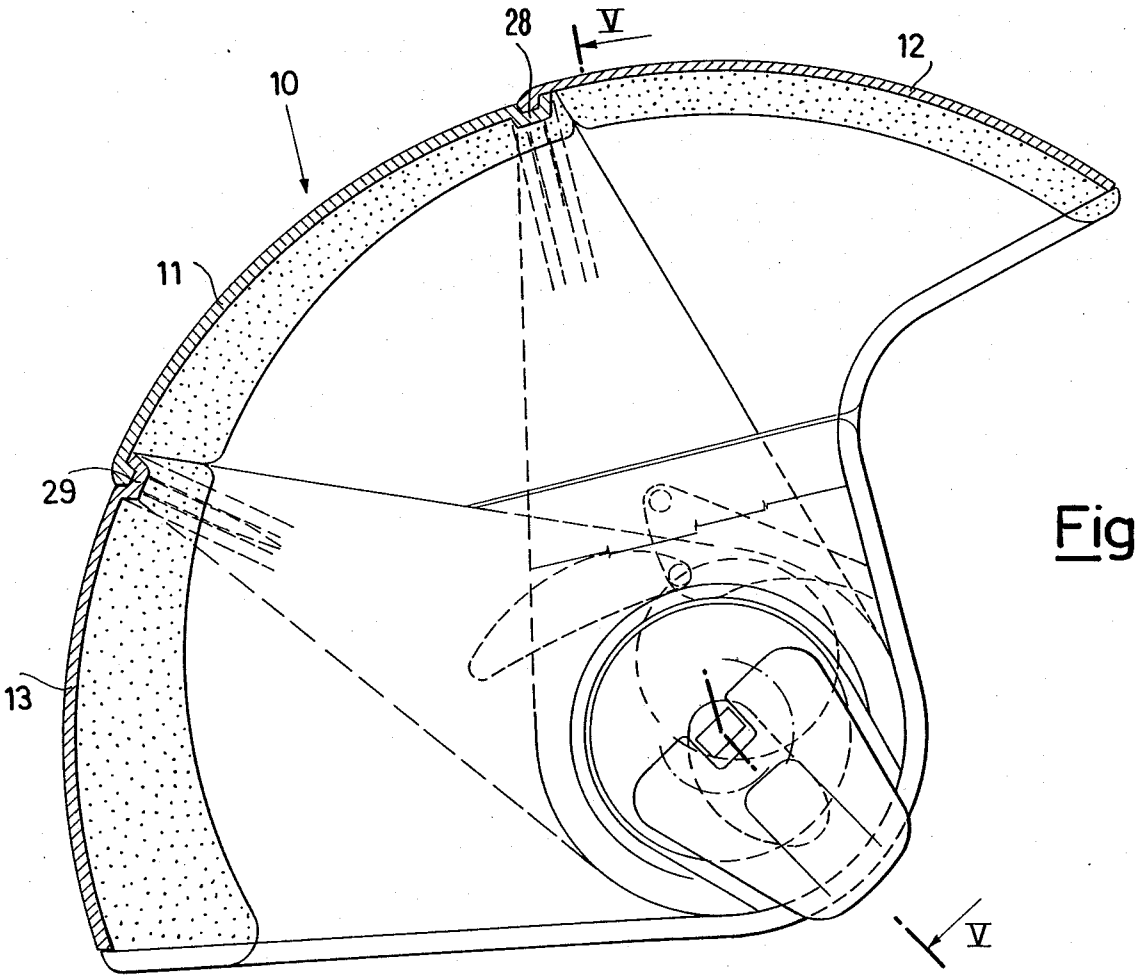
FIG. 2 is a sectional view of the helmet of FIG. 1.

The helmet is in this manner kept positively locked in the expanded operating position shown in FIGS. 1 and 2.

Figure 5:
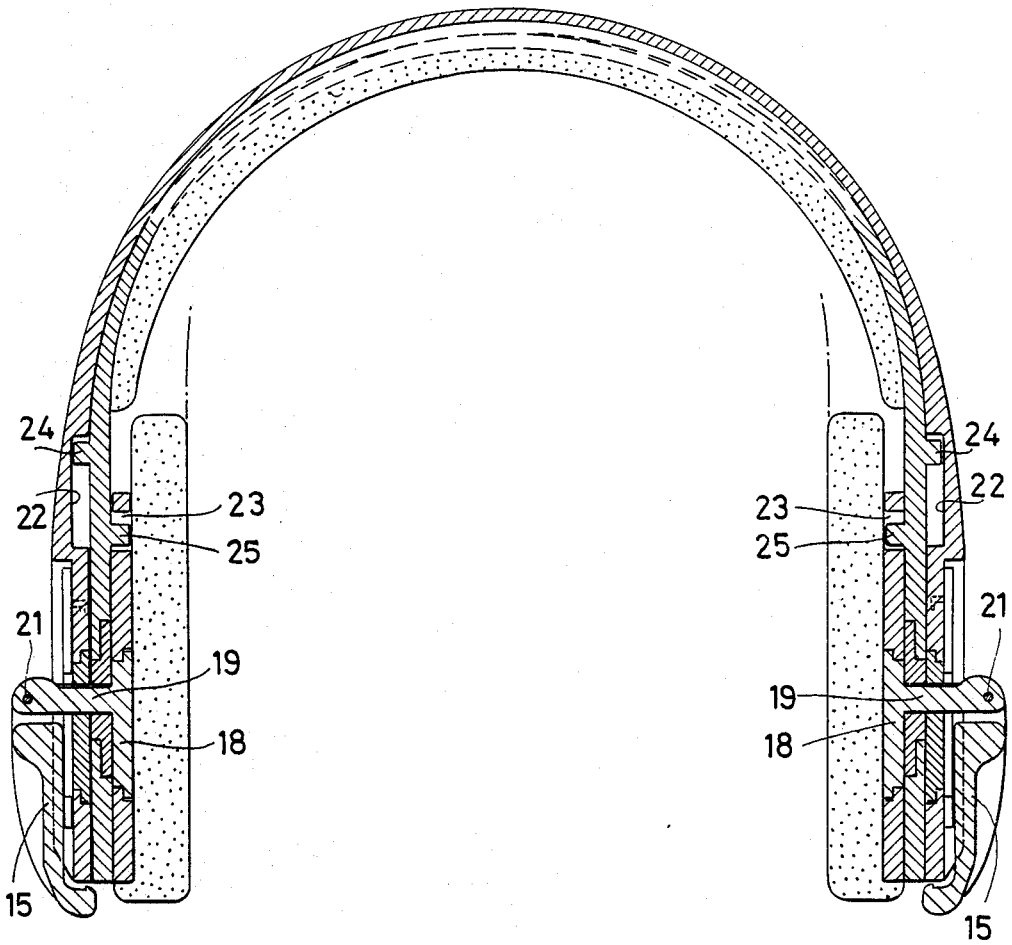
FIG. 5 is a sectional view taken on the line V—V of FIG. 2.

As will be clear, the locking of the segments in the aforesaid expanded position is actuated by moving the knobs 15 from the position of FIG. 9, in which the adjacent sides of the sections are slightly spaced from each other, to the position of FIG. 5, in which the toggle 30 exerts an action of reciprocal moving together (approach), and thus cause adjacent sides of the sections to engage each other and thereby to produce a stable clamping between the said segments 11, 12 and 13.

In cooperation with the pegs 24, 25, the guides 22, 23 assure the correct disengagement of the ribs 26, 27 from the notches 28, 29 in the phase of collapsing the helmet into the position shown in FIG. 3, such phase being actuated by rotation of the cam sets 14 in the direction opposite to the previous one.

The object mentioned in the introductory part of the description is thus achieved.

I claim:

1. In a protective helmet of the type comprising a plurality of arcuate segments having overlapping end portions at opposite sides of said helmet that are interhinged by eccentric mounting means to support said segments for swinging and radial movement relative to each other about a hinge axis between an expanded operating portion and a collapsed non-operating position, and reciprocal restraining and locking means acting between said segments releasably to maintain them in the said expanded operating position, the improvement comprising guide means interposed between each pair of confronting surfaces of said overlapping end portions of said segments and adapted positively to guide the swinging movement of said segments about said axis so as to assure a correct reciprocal engagement and disengagement of said restraining means, said guide means comprising a projection on one of said confronting surfaces of each pair thereof extending slidably into a recess formed in the other surface of said pair.

2. In a protective helmet as described in claim 1, wherein the said restraining means comprises a plurality of ribs and complementary notches formed respectively on the inner and outer faces of the said segments.

3. In a protective helmet as described in claim 1, wherein said said mounting means comprises two sets of cams each comprising a plurality of discs rotatably mounted within complimentary seats formed in the said segments, there being solid with the innermost disc a pin which passes through eccentric holes of the other discs to project outside the helmet as a head to which is pivoted a knob for segment moving a locking purposes.

* * * * *